United States Patent [19]

Myers

[11] Patent Number: 4,964,464

[45] Date of Patent: Oct. 23, 1990

[54] ANTI-SAND BRIDGE TOOL AND METHOD FOR DISLODGING SAND BRIDGES

[75] Inventor: Larry G. Myers, Ennis, Tex.

[73] Assignee: Mobil Oil Corporation, Fairfax, Va.

[21] Appl. No.: 429,518

[22] Filed: Oct. 31, 1989

[51] Int. Cl.[5] ..... E21B 37/08

[52] U.S. Cl. ..... 166/278; 166/177

[58] Field of Search ..... 166/278, 376, 177, 243, 166/311, 312, 222, 223, 178; 15/382

[56] References Cited

U.S. PATENT DOCUMENTS

| | | | |
|---|---|---|---|
| 2,174,348 | 9/1939 | Damond | 222/196 |
| 3,101,499 | 8/1963 | Greenfield | 166/177 X |
| 3,770,054 | 11/1973 | Solum | 166/177 |
| 3,830,294 | 8/1974 | Swanson, Jr. | 166/51 |
| 3,897,605 | 8/1975 | Dickinson | 15/382 |
| 4,192,375 | 3/1980 | Maly et al. | 166/51 |
| 4,711,302 | 12/1987 | Jennings, Jr. | 166/250 |
| 4,815,653 | 3/1989 | Autry et al. | 299/18 |

*Primary Examiner*—William P. Neuder

*Attorney, Agent, or Firm*—A. J. McKillop; C. J. Speciale; M. J. Mlotkowski

[57] ABSTRACT

An anti-sand bridge tool for dislodging a sand bridge between a liner wall and a casing wall of a gravel packed well completion. The tool comprises a tubular sub pipe having a first end and a second end, the first end having means for connecting the tubular sub pipe to a tubular work string; a hollow flexible member for delivering a fluid at high pressure having a first end and a second end, the first end of the flexible member adapted for attachment to the second end of the tubular sub pipe; and a striking means having a fluid inlet orifice and at least one fluid exit orifice, the fluid inlet orifice connected to and in fluid communication with the second end of the flexible member; whereby initiation of fluid flow through the tool effects an arcuate movement of the striking means resulting in the striking means contacting the liner wall in a manner effective to dislodge a sand bridge. Also provided is a method for dislodging sand bridges encountered during gravel packing operations.

19 Claims, 2 Drawing Sheets

ANTI-SAND BRIDGE TOOL AND METHOD FOR DISLODGING SAND BRIDGES

FIELD OF THE INVENTION

The present invention relates generally to gravel packs used in subterranean wells to remove sand particles from production fluids and, more particularly, to a tool for dislodging sand bridges encountered in such gravel packs.

BACKGROUND OF THE INVENTION

In the production of formation fluids, including crude oils and other hydrocarbons, the characteristics of the formation can have a substantial effect on the efficiency of production. Recovery of formation fluids is frequently difficult when the subterranean formation is comprised of one or more incompetent or unconsolidated sand layers or zones. Sand layers in the incompetent or unconsolidated sand zone can move or migrate into the well bore during the recovery of formation fluids from that zone. As is well known, the movement of sand into well bore can cause the well to cease production of reservoir fluids. Not only can fluid production be reduced or even stopped altogether if sand particles flow from the well to the surface, serious mechanical problems can result from the passage of abrasive sand particles through pumps and other mechanical devices.

A conventional technique for completing a well in an incompetent formation to substantially prevent entrainment of earth particles into the well involves running one or more strings of casing into the well bore and then running the actual production tubing inside the casing. At the wellsite, the casing is perforated across the productive zones of the reservoir to permit production fluids to enter the well bore. While it is possible to have an open face across the oil- or gas-bearing zone, it is such an arrangement which permits formation sand to be swept in to the well bore. To correct this problem, sand screening is usually employed in the region opposite the casing perforations. Packers may also be used above and below the sand screens to seal off the portion where production fluids flow in to the tubing from the rest of the annulus. The annulus around the screen is conventionally packed with relatively coarse sand or gravel to reduce the amount of formation sand reaching the screen. A work string is used to spot the gravel around the screen, as those skilled in the art readily understand. The gravel can be hydraulically placed in the annular void space by circulating a suspension of the gravel in water or some other liquid through the void space so that the gravel is deposited therein.

Ideally, the gravel so placed should fill the annulus between the sand screen and the casing. Unfortunately, spaces often remain within the annulus which are not filled with gravel. These spaces will eventually become filled with accumulated formation sand, forming sand plugs or bridges. In practice a number of such bridges may occur, particularly in long perforate liners. Sand bridges greatly reduce the effectiveness of the gravel pack by permitting the formation sand to migrate through the sand bridges and into the production flowpath, resulting in the problems previously decribed.

a variety of tools and processes have been developed to minimize the occurrence of voids and sand bridges in the gravel pack. One such conventional process employs a washing tool to wash the perforations in casing and sand control screens. By establishing flow at relatively high pressures, such tools can often open a void in the gravel packing or dislodge a sand bridge. One such tool is commonly referred to as a swab cup straddle-type tool. Such tools create hydraulic turbulence to dislodge sand bridges. Another type of device is disclosed in U.S. Pat. No. 4,711,302, issued to Jennings. This device utilizes a high energy impulse to remove void spaces in an in-casing-type gravel pack. In practice, the device is placed in close proximity to a void space and detonated. Upon detonation, the device generates a level of energy sufficient to create turbulence and agitation of the gravel within the gravel pack. The level of turbulence is said to be sufficient to readjust and consolidate the gravel within the pack.

Althugh these tools and processes which rely solely upon turbulence are often effective in the removal of gravel pack voids and sand bridges, a need still exists for a tool which can deliver a localized force effective to dislodge sand bridges within a gravel packed well completion.

SUMMARY OF THE INVENTION

Provided is an anti-sand bridge tool for dislodging a sand bridge between a liner wall and a casing wall of a gravel packed well completion. The tool comprises a tubular sub pipe having a first end and a second end, the first end having means for connecting the tubular sub pipe to a tubular work string; a hollow flexible member for delivering a fluid at high pressure having a first end and a second end, the first end of the flexible member adapted for attachment to the second end of the tubular sub pipe; and a striking means having a fluid inlet orifice and at least one fluid exit orifice, the fluid inlet orifice connected to and in fluid communication with the second end of the flexible member; whereby initiation of fluid flow through the tool effects an arcuate movement of the striking means resulting in the striking means contacting the liner wall in a manner effective to dislodge a sand bridge. Also provided is a method for dislodging sand bridges encountered during gravel packing operations.

It is therefore an object of the present invention to provide an effective and novel tool to remove sand bridges from gravel packed well completions used in the production of fluids from a substerranean formation.

It is another object of the present invention to provide a method for dislodging sand bridges from gravel packs.

It is a further object of the present invention to provide a tool to remove voids from gravel packed well completions used in the production of fluids from a subterranean formation.

It is still another object of the present invention to provide a method for removing voids from gravel packs.

It is a still further object of the present invention to provide a tool to dislodge sand bridges from gravel packed well completions which utilizes localized mechanical impact to effect the dislodging of sand bridges.

Other objects, aspects and the several advantages of the present invention will become apparent to those skilled in the art upon a reading of the specification and the claims appended thereto.

DETAILED DESCRIPTION OF THE INVENTION

Figure 1:
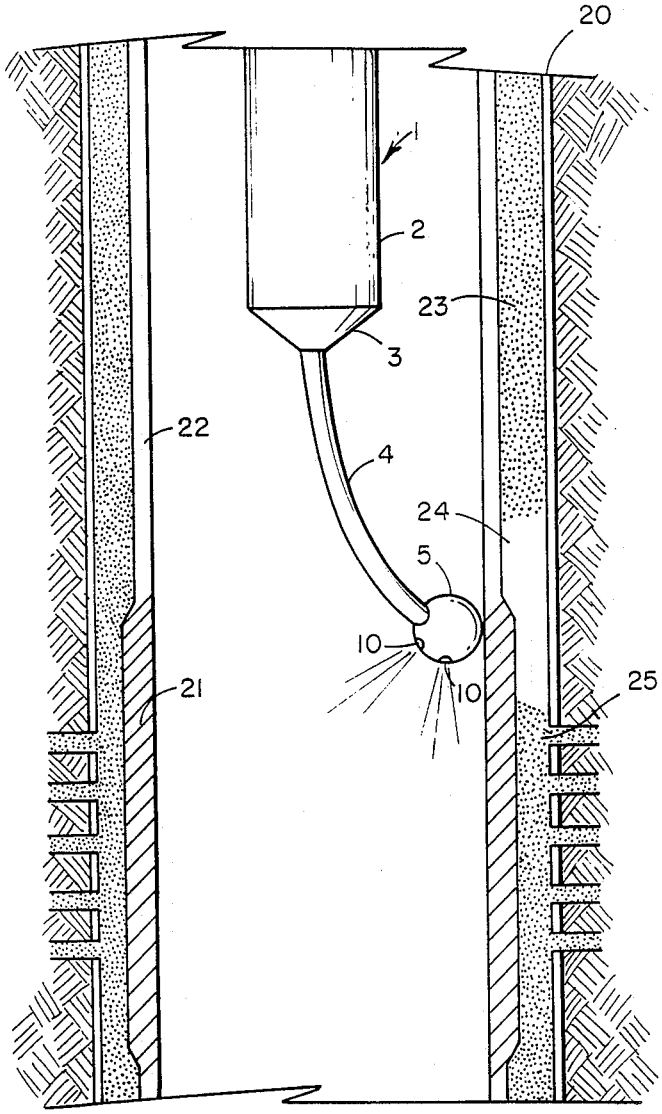
FIG. 1 is a longitudinal cross-sectional view of an in-casing gravel pack having a void within the gravel pack created by a sand bridge. A tool for dislodging sand bridges of the present invention is shown in the vicinity of the sand bridge.

The actual configuration, use and the several advantages of the present invention will be understood by referring to the drawings in which like numeral identify like elements. While this invention is susceptible of embodiment in many different forms, there is shown in detail a specific embodiment which is to be considered as an exemplification of the principles of the invention and not intended to limit the invention.

Referring now the FIG. 1, a longitudinal cross-sectional view of a well bore using an in-casing gravel pack is shown. The arrangement shown is conventional, as those skilled in the art will plainly recognize. Casing 20 is shown within the well bore and is cemented in place in the usual manner. Casing 20 has perforations 25 located circumferentially in the producing zone of the well. Wire wrapped sand screen 21 is located in the region where the casing perforations are located, consistent with common practice. Blank liner 22 is located above wire wrapped screen 21 in the non-producing zone. In the annular region between casing wall 20 and the combination of wire wrapped screen 21 and blank liner 22 is a gravel pack 23. As may be seen, the presence of sand bridge 24 has caused a void within gravel pack 23.

Shown within the well bore is an anti-sand bridge tool 1, according to the present invention. The tool comprises, in its esential elements, a tubular sub pipe 2 one end of which connects to a conventional tubular work string (not shown). The other end of tubular sub pipe 2 is connected t hollow flexible member 4, which may be a high pressure hose. Hollow flexible member 4, is employed for delivering a fluid at high pressure. Connected to one end of flexible member 4 is striking means 5, which can be, as is preferred, a steel ball-like structure. As shown, striking means 5 has two fluid exit orifices 10. By proper positioning of these orificies, the initiation of fluid flow through tool 1 effects an arcuate movement of striking means 5, resulting in striking means 5 contacting the liner wall, as shown in FIG. 1. Such contact is effective in dislodging sand bridges.

Figure 2:
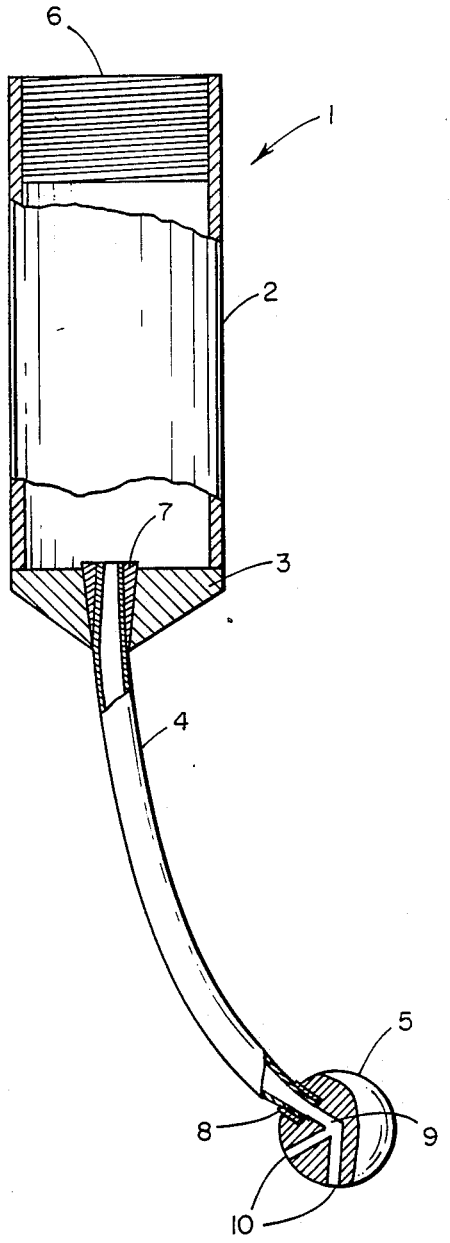
FIG. 2 is a longitudinal view, shown in partial cross section, of a tool for dislodging sand bridges, according to the present invention.

Referring now to FIG. 2, a detailed drawing of anti-sand bridge tool 1 is provided in partial cross section. As shown, tubular sub pipe 2 is provided, as is preferred, with threaded end 6 for connecting to a conventional tubular work string (not shown). The threads of threaded end 6 can be either external to tubular sub pipe 2 or internal, as shown, as required by the configuration of the tubular work string. The end of tubular sub pipe 2 which is connected to hollow flexible member 4, is provided with plug end 3, which may be machined from bar stock and affixed to tubular sub pipe 2 in any conventional manner which provides a leak free joint capable of withstanding pressures in excess of 100 psig. Hollow flexible member 4, is a high pressure hose, and is used for delivering fluid to striking means 5, which, as is preferred, is spherically shaped. In a preferred arrangement, flexible member 4, is connected to plug end 3, through the use of high pressure hose clamp 7. Such a clamp is of the type commonly employed by those skilled in the art of reservoir production.

As shown, striking means 5 has a fluid inlet orifice 9 and two fluid exit orifices 10. Striking means 5 is connected to flexible member 4, through the use of high pressure hose clamp 8. This clamp is of a type which is similar to high pressure hose clamp 7. As indicated, by proper positioning of exit orifices 10, the initiation of fluid flow through tool 1 effects an arcuate movement of striking means 5 through the angular momentum generated by the initiation of fluid flow through striking means 5. As can be envisioned, at least one fluid exit hole 10 is required and, to effect arcuate movement of striking means 5, inlet orifice 9 and exit orifice 10 should not be diametrically opposed. As is preferred, to effect good movement of striking means 5, two exit orifices 10 are utilized. It is preferred that these orifices be located, radially, about 20 to about 90 degrees from each other, with radial spacing of about 30 to about 45 degrees particularly preferred. Moreover, radial displacement of exit orifices 10 relative to inlet orifice 9 is also important in effecting good movement of striking means 5. It is believed that radial spacing of the inlet and exit orifices within a range of angles from about 30 to about 90 degrees will provide effective movement of striking means 5. It is particularly preferred to provide a radial displacement of approximately 60 degrees between exit orifices 10 and inlet orifice 9.

Reference will again be made to FIG. 1 to provide illustration concerning the method of use of anti-sand bridge tool 1 of the present invention. To utilize anti-sand bridge tool 1, it is essential that the approximate locations of any sand bridges be determined. This can be accomplished through the use of any of the well known downhole logging techniques designed to accomplish such a task, as those skilled in the art will readilly recognize. Following the determination of the relative location of a sand bridge, anti-sand bridge tool 1 is coupled to a tubular work string capable of delivering a high pressure fluid. Anti-sand brigde tool 1 is then lowered into the well bore to a point where striking means 5 is adjacent to sand bridge 25. Following the proper placement of anti-sand bridge tool 1, the high pressure fluid source is cycled on and off. This may be done manually, although, as can be appreciated, automatic control of this step is clearly advantageous. As mentioned, it is the initiation of fluid flow which creates the angular momentum necessary to effect the arcuate movement of striking means 5 which causes striking means 5 to contact either blank liner wall 23 or screen 21. As can be appreciated, the higher the pressure at which fluid is supplied to the tool, the greater the force of impact will be. While pressures on the order of 100 psig are known to be effective, higher pressures may often be required, as those skilled in the art will understand.

Another advantage of the present invention is achieved by the fact that fluid flow is utilized to effect the mechanical impact of striking means 5 with liner wall 23 or screen 24. The flow of fluid can create hydraulic turbulence which can aid in the dislodging of sand bridge 25 through the use of the inherent washing action and the force of the fluid supply itself contacting the sand bridge. As can be visualized, the combination of the fluidic action and impact forces are advantageously utilized to dislodge the offending sand bridge and permit gravel pack 23 to settle and fill the void previously occupied by sand bridge 25.

Although the present invention has been described with preferred embodiments, it is to be understood that modifications and variations may be made without departing from the spirit and scope of this invention, as those skilled in the art will readily understand. Such modifications and variations are considered to be within the purview and scope of the appended claims.

What is claimed is:

1. An anti-sand bridge tool for dislodging a sand bridge located between a linear wall and a casing wall of a gravel packed well completion, comprising:

(a) a tubular sub pipe having a first end and a second end, said first end having means for connecting said tubular sub pipe to a tubular work string;

(b) a hollow flexible member for delivering a fluid at high pressure having a first end and a second end, said first end of said flexible member adapted for attachment to said second end of said tubular sub pipe; and (c) a striking means having a fluid inlet orifice and at least two fluid exit orifices, said fluid inlet orifice connected to and in fluid communication with said second end of said flexible member; whereby initiation on fluid flow through the tool effects an arcuate movment of said striking means resulting in said striking means contacting the liner wall in a manner effective to dislodge a sand bridge.

2. The tool of claim 1, wherein said striking means is substantially spherical.

3. The tool of claim 2, wherein said at least two fluid exit orifices are located at a radial displacement of about 20 to about 90 degrees from each other.

4. The tool of claim 2, wherein said striking means is constructed from a ferrous materials.

5. The tool of claim 3, wherein said hollow flexible member is a high pressure hose.

6. The tool of claim 5, wherein said at least two fluid exit orifices are located at a radial displacement of about 30 to about 45 degrees from each other.

7. The tool of claim 1, wherein said hollow flexible member is a high pressure hose.

8. The tool of claim 6, wherein said fluid inlet orifice and said at least two fluid exit orifices are located at a radial displacement of about 30 to about 90 degrees from each other.

9. The tool of claim 1, wherein said fluid inlet orifice and said fluid exit orifice are located at a radial displacement of about 30 to about 90 degrees from each other.

10. A method for dislodging a sand bridge between a liner wall and a causing wall of a gravel packed well completion, comprising the steps of: (a) locating a sand bridge within the gravel packed well completion; (b) positioning an anti-sand bridge tool within the well bore substantially adjacent to the sand bridge, the tool comprising: a tubular sub pipe having a first end and a second end, the first end having means for connecting the tubular sub pipe to a tubular work string; a hollow flexible member for delivering a fluid at high pressure having a first end and a second end, the first end of the flexible member adapted for attachment to the second end of the tubular sub pipe; and a striking means having a fluid inlet orifice and at least one fluid exit orifice, the fluid inlet orifice connected to and in fluid communication with the second end of the flexible member; and (c) cycling a flow of fluid on and off so that initiation of fluid flow through the tool effects an arcuate movement of the striking means resulting in the striking means contacting the liner wall in a manner effective to dislodge a sand bridge.

11. The method of claim 10, wherein in step (b) the striking means has at least two fluid exit orifices.

12. The method of claim 11, wherein in step (b) the striking means is substantially spherical.

13. The method of claim 12, wherein in step (b) the at least two fluid exit orifices are located at a radial displacement of about 20 to about 90 degrees from each other.

14. The method of claim 12, wherein in step (b) the striking means is constructed from a ferrous material.

15. The method of claim 13, wherein in step (b) the hollow flexible member is a high pressure hose.

16. The method of claim 15, wherein in step (b) the at least two fluid exit orifices are located at a radial displacement of about 30 to about 45 degrees from each other.

17. The method of claim 10, wherein in step (b) the hollow flexible member is high pressure hose.

18. The method of claim 16, wherein in step (b) the fluid inlet orifice and said at least two fluid exit orifices are located at a radial displacement of about 30 to about 90 degrees from each other.

19. the method of claim 10, wherein in step (b) the fluid inlet orifice and said fluid exit orifice are located at a radial displacement of about 30 to about 90 degrees from each other.

* * * * *